US007918602B2

(12) United States Patent
Wyssbrod

(10) Patent No.: US 7,918,602 B2
(45) Date of Patent: Apr. 5, 2011

(54) BISTABLE HAMMER FOR A CHRONOGRAPH MECHANISM

(75) Inventor: Baptist Wyssbrod, Nidau (CH)

(73) Assignee: Omega S.A., Bienne (CH)

( * ) Notice: Subject to any disclaimer, the term of this patent is extended or adjusted under 35 U.S.C. 154(b) by 94 days.

(21) Appl. No.: 12/339,206

(22) Filed: Dec. 19, 2008

(65) Prior Publication Data

US 2009/0161493 A1 Jun. 25, 2009

(30) Foreign Application Priority Data

Dec. 21, 2007 (EP) ..... 07150324

(51) Int. Cl.
*G04F 7/08* (2006.01)

(52) U.S. Cl. ..... 368/106; 368/101

(58) Field of Classification Search ..... 368/101–106
See application file for complete search history.

(56) References Cited

U.S. PATENT DOCUMENTS 3,457,720 A 7/1969 Bachmann
5,793,708 A 8/1998 Schmidt et al.
7,029,169 B2 4/2006 Takahashi et al.
2004/0218473 A1 11/2004 Takahashi et al.
2006/0207198 A1 * 9/2006 Sondermann ..... 52/220.1
2007/0206447 A1 9/2007 Hiraya et al.

FOREIGN PATENT DOCUMENTS

EP 0 772 104 A1 5/1997
EP 1 462 884 B1 5/2008

OTHER PUBLICATIONS

European Search Report issued in corresponding application No. EP 07 15 0324, completed Aug. 29, 2008.

* cited by examiner

*Primary Examiner* — Renee Luebke
*Assistant Examiner* — Jason Collins
(74) *Attorney, Agent, or Firm* — Griffin & Szipl, P.C.

(57) ABSTRACT

The invention relates to a chronographic timepiece and a chronograph mechanism (7) thereof including an elapsed time indicator member (17), a reset control member (21), and a reset device (25) for the indicator member, which includes a hammer (61), mounted in translation between an inactive position, where the hammer (61) is moved away from heart-pieces (55, 57, 59) that are connected to the indicator member (17), and an active position where stop members (54, 56, 58) of the hammer exert a reset force against the heart-pieces. The hammer (61) includes two studs (64, 66) mounted so as to slide in holes (100, 102) such that the movement vectors (L, K) of the studs (64, 66) between the positions are collinear and not aligned.

14 Claims, 7 Drawing Sheets

BISTABLE HAMMER FOR A CHRONOGRAPH MECHANISM

This application claims priority from European Patent Application No. 07150324.7 filed Dec. 21, 2007, the entire disclosure of which is incorporated herein by reference.

FIELD OF THE INVENTION

The invention relates to a bistable hammer for a chronograph mechanism.

It applies, in particular, to "two stage" chronographs, which have two push-buttons, in this case a first push-button, which starts and stops the chronograph mechanism and a second push-button, which controls the reset function.

BACKGROUND OF THE INVENTION

It is known to mount a chronograph mechanism hammer in an elastic manner, i.e. so that at the moment when the indicator device is activated by a first push-button, the hammer is mechanically brought into a clicked position. A second push-button activates the reset function, which then moves the click, enabling the hammer to be repositioned against the heart-pieces of the mechanism, by elastic let down.

This type of system is complex to implement and requires the push-buttons to be very indirectly linked to the member to be controlled. Indeed, the reset movement assumes that the click or hook used is not exerting too much force, so that the hammer can be released by the user via action that he finds acceptable, but also that a minimum force is being exerted, so that the hammer is not accidentally released when the timepiece is subjected to acceleration.

SUMMARY OF THE INVENTION

It is an object of the present invention to overcome all or part of the aforementioned drawbacks by proposing a less complex chronograph mechanism, which is activated more directly by the push-buttons and whose hammer thus operates more reliably.

The invention therefore relates to a chronograph mechanism comprising an elapsed time indicator member, a reset control member, a device for resetting said indicator member to zero, including a hammer mounted in translation between an inactive position, where the hammer is moved away from the heart-pieces that are connected to the indicator member, and an active position, where stop members for said hammer exert a reset force against said heart-pieces. The invention is characterized in that the hammer includes two studs, mounted so as to slide in holes, such that the movement vectors of the studs between said positions are collinear and not aligned. This allows the reset device to be activated by one stud and deactivated by the other.

According to other advantageous features of the invention:

- a first one of said studs is secured to a hammer lever that moves the hammer from its active position to its inactive position;
- the first stud in slidebly mounted is a second hole arranged at one each of the hammer lever;
- the first end includes an arm that is approximately oriented in the extension of the hammer, so as to optimise the movement of said hammer by the lever;
- the hammer lever is rotatably mounted;
- the hammer lever cooperates with a bistable jumper spring, to make each of the two positions of the hammer stable;

- the hammer lever includes a pin that enters into contact with a different surface of the jumper spring for each position of the hammer, so as to make the positions of said hammer stable, via a single jumper spring;
- at least one of the surfaces of the jumper spring includes a notch for receiving the lever pin, so as to improve the stability of cooperation between the lever and said jumper spring;
- the two surfaces of the jumper spring are mounted perpendicularly to each other;
- the movement of the hammer lever, from the active hammer position to the inactive position, is initiated by contact between the second stud and a part that is mechanically driven by a member controlling the stop and start functions of said mechanism;
- the movement of the hammer lever, from the inactive hammer position to the active position, is initiated by contact between the second stud and a part that is mechanically driven by a member for controlling the reset of said mechanism;
- the elastic let down of the jumper spring ends each movement of the hammer lever;
- the hammer includes two arms hinged to each other.

The invention also relates to a timepiece, characterized in that it includes a chronograph mechanism according to any of the preceding variants.

Other features and advantages will appear clearly from the description that is given below, by way of non-limiting illustration, with reference to the annexed drawings, in which.

DETAILED DESCRIPTION OF PREFERRED EMBODIMENTS

Figure 1:
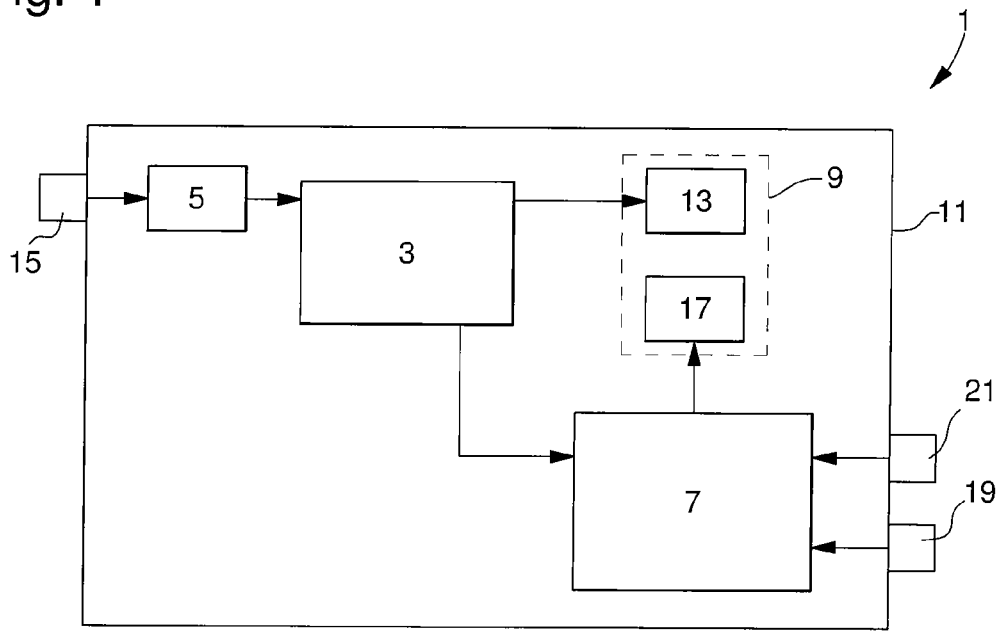
FIG. 1 is a schematic diagram of a timepiece according to the invention.

As illustrated in FIG. 1, the invention concerns a timepiece 1, whose case 11 includes a timepiece movement 3, a time-setting system 5, a chronograph mechanism 7 and a display system 9.

Timepiece movement 3, which is preferably mechanical, moves an indicator device 13 of display system 9, which may, for example, include a dial with an hour index and hands, which move above the dial and are connected to timepiece movement 3. The movement can be set via time-setting system 5, for example by operating a crown 15, which projects from case 11. As timepiece movement 3 is not protected by the invention, it will not be explained further here.

Two stage chronograph mechanism 7 moves a second indicator device 17, including at least one counter belonging to display system 9. Chronograph mechanism 7 is controlled by two control members 19, 21 and includes, as can be seen in FIG. 2, a control system 23, a reset device 25, a gear train device 27, a coupling device 29, an immobilising device 31, two anti-shock devices 33, 35 and force equalising device 37.

According to the invention, control members 19 and 21 are preferably push-buttons that project from case 11. Only one, 19, of push-buttons 19, 21 thus cooperates with control system 23 to activate alternately the stop and start function of indicator device 17. The first push-button 19 also deactivates reset device 25, when it starts chronograph mechanism 7. The second push-button 21 only controls the activation of the reset device 25.

Figure 2:
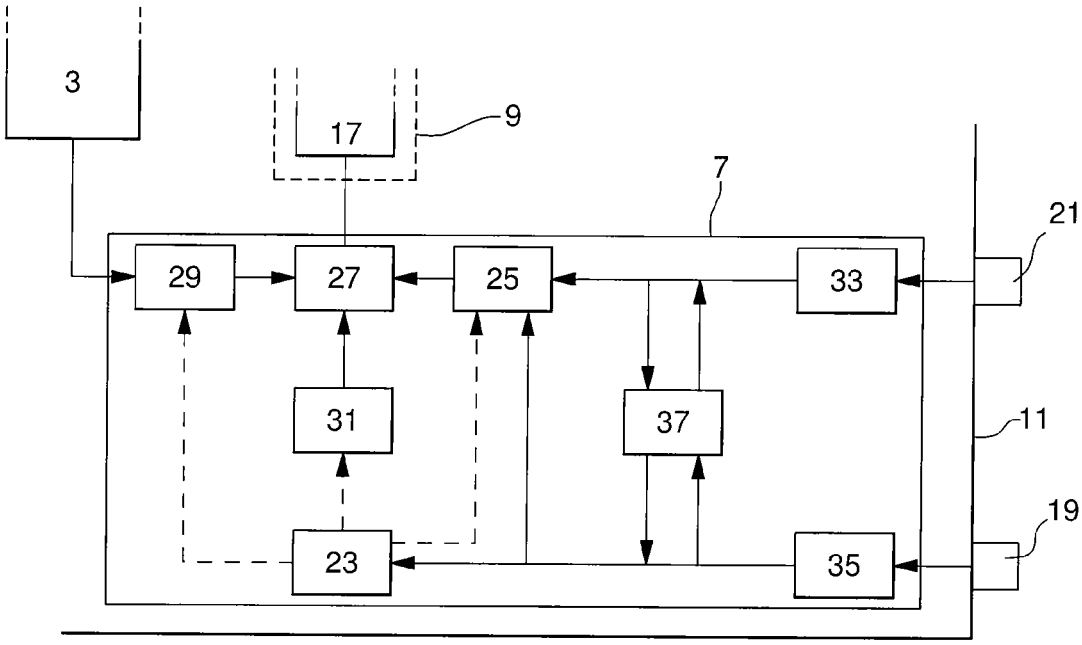
FIG. 2 is a schematic diagram centred on the chronograph mechanism according to the invention.

Control system 23 controls the coupling and immobilising devices 29 and 31, as illustrated in FIG. 2 by short dotted lines. When the start control is activated (i.e. first push-button 19), control system 23 controls coupling device 29 such that gear train device 27 selectively interlocks with a wheel of timepiece movement 3, to divert part of the drive force of said movement. Control system 23 also controls immobilising device 31 so that gear train device 27 is selectively made static, in order to keep indicator device 17 immobile and thus facilitate reading of the indicator device, when the stop control is activated (i.e. push-button 19).

Control system 23 also indirectly controls reset device 25, as illustrated in FIG. 2 by short dotted lines. In fact, control system 23 prevents reset device 25 being activated when chronograph mechanism 7 is operating. Thus the reset device can only be activated when chronograph mechanism 7 is stopped, as explained below.

As uncoupling and immobilising devices 29 and 31 are not protected by the invention, they will not be explained further below. It is, however, specified that they could be of various types, such as, for example, friction or locking types.

Reset device 25 acts on gear train device 27, to reinitialise indicator device 17. Thus, when the reset control is activated (i.e. push-button 21), reset device 25 is activated via control system 23, as explained above. Moreover, reset device 25 is deactivated at the same time that the start control is activated (i.e. first push-button 19).

Preferably, according to the invention each push button 19, 21 respectively includes an anti-shock device 35, 33 intended to protect the chronograph mechanism 7 against violent shocks exerted on push-buttons 19, 21. Such shocks can for example be caused by the contact of one of push-buttons 19, 21 against the ground when the timepiece 1 is dropped.

By way of example the acceleration caused by such a shock when dropped from a height of one mater can reach 5000 g.

The anti-shock devices 35, 33 are explained in detail below.

Preferably, according to the invention, the chronograph mechanism 7 also includes a force equalising device 37, which makes the force to be exerted on each push-button 19, 21 reproducible over time, in order to activate the appropriate functions. Without necessarily having to be identical, said forces must thus more or less vary over time in accordance with the same factor, which may be less than or greater than 1. The force equalising device 37 is explained in more detail below.

Control system 23, reset device 25, anti shock devices 33, 35 and force equalising device 37 will now be explained with reference to FIGS. 3 to 8.

Figure 3:
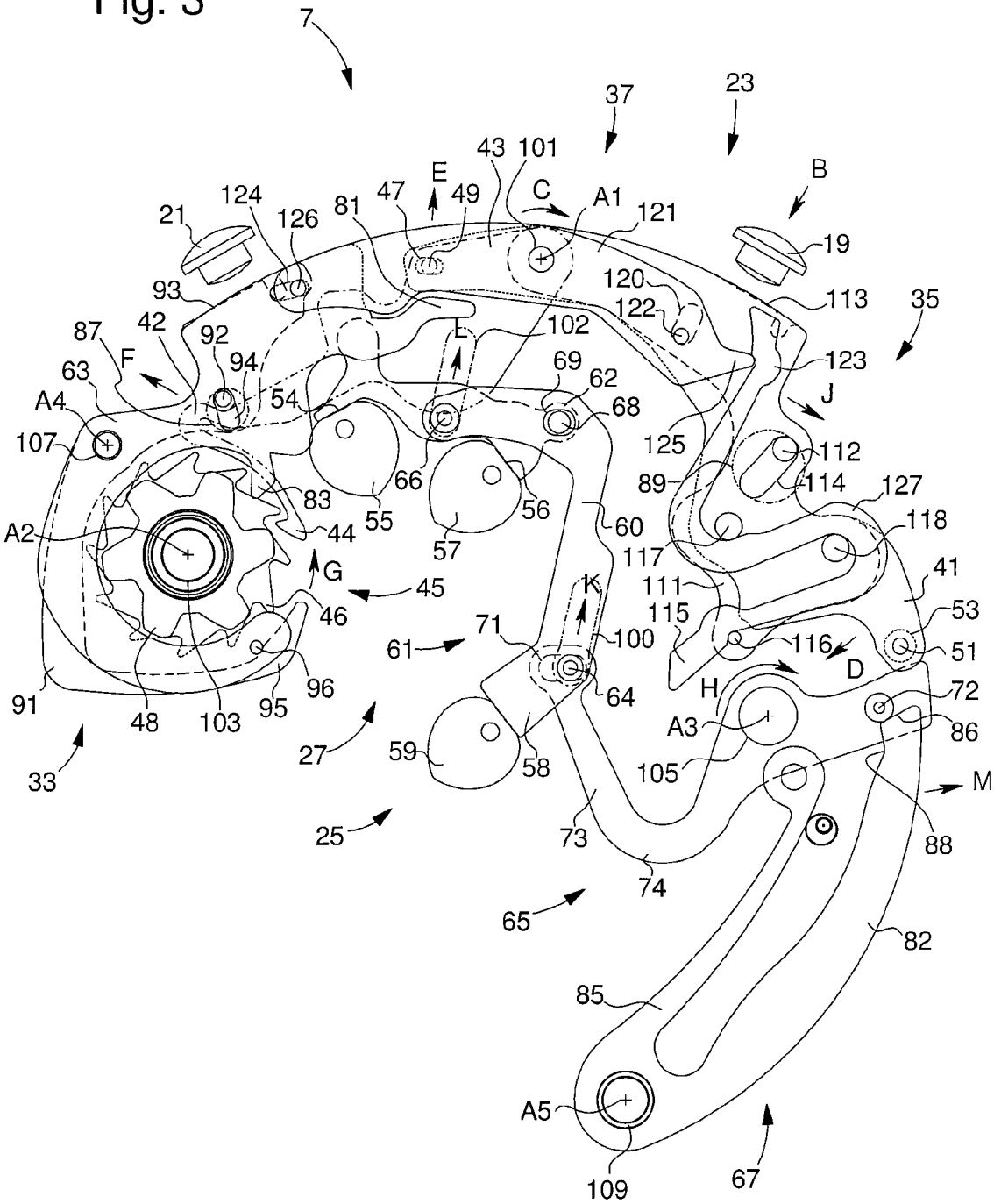
FIG. 3 is an overall view of a chronograph mechanism in its inactive position.

Control system 23 includes a control lever 41, an operating lever hook 43 and a column wheel 45. Lever 41 is essentially flat and is rotatably mounted against a pivot 101 forming a axis A1. At one end of lever 41, close to pivot 101, there is an elongated hole 47, into which a stud 49 slides, said stud being secured to lever hook 43. As shown in FIG. 3, a fixed pin 51 is mounted approximately perpendicularly at the other end of lever 41. A roller 53 is preferably freely mounted on the external diameter of one part of pin 51.

The approximately flat lever hook 43 is also rotatably mounted against pivot 101 at one of its ends. Lever hook 43 is driven by the trigonometric or backward rotation of lever 41, via stud 49 thereof, which is mounted approximately perpendicularly. At the other end of lever hook 43, there is arranged a useful part forming a hook 44, via a bent portion 42 that can orient the useful hook part 44 approximately tangentially, relative to the toothings of column wheel 45.

As is shown in FIG. 3, column wheel 45 is rotatably mounted against a pivot 103 that forms axis A2. Column wheel 45 includes a ratchet wheel 46, above which there is mounted a notched wheel 48, whose notches are used as columns. As visible in the same Figure, hook 44 faces one tooth of ratchet wheel 46.

Reset device 25 includes a hammer 61, a reset lever 63, a hammer lever 65 and a hammer jumper spring 67. In the usual way, hammer 61 strikes the peripheral wall of heart-pieces 55, 57, 59, which are secured to gear train device 27, in order to mechanically force the heart-pieces to return to the position for reinitialising indicator device 17.

As can be seen in FIG. 3, gear train device 27 preferably includes three heart-pieces 55, 57 and 59, which means that indicator device 17 has three counters, for example, for the seconds, minutes and hours. According to the invention, hammer 61 preferably has two arms 60, 62, which are hinged to each other, in order to distribute the strike force better.

The first, approximately L-shaped arm 60, has a stop member 58, for striking a first heart-piece 59, arranged at the end of the vertical part. A stud 64, which passes through the thickness of first arm 60, is mounted in proximity to this stop member 58. Thus, the bottom part cooperates by sliding into a hole 71 in hammer lever 65 and the top part cooperates by sliding into another hole 100 arranged in a part located above chronograph mechanism 7.

In order to reduce friction, a roller is preferably mounted to move freely on the external surfaces of the bottom part and top part, as for pin 51. Moreover, as visible in FIGS. 3 to 8, hole 100 has an enlarged portion at the bottom vertical end thereof, to give the roller of the top part of stud 64 more freedom when the roller is moving therein. This advantageously enables hammer 61 to impart a slight rotation, which can compensate for the slight time differences in strikes by hammer 61.

The end of the horizontal part of first arm 60 has a second stud 66 of the same type as first stud 64, i.e. it passes right through first arm 60. The bottom part is rotatably mounted relative to second arm 62, and the top part is mounted so as to slide into a hole 102, arranged in a part located above chronograph mechanism 7. In the same, preferred manner as for stud 64, stud 66 has a roller that is mounted to move freely and coaxially to the top part.

The second arm 62, which is approximately wave-shaped, has two stop members 54 and 56, for respectively striking each of the last two heart-pieces 55 and 57. In order to limit the amplitude of any relative movements between the first 60 and second 62 arms, a finger 68 is provided on second arm 62, for sliding into groove 69 of first arm 60. This configuration of hammer 61 also makes movement tolerance possible during the reset phases, which enables hammer 61 to compensate for any slight time differences in the strikes of each stop member 54, 56, 58 against the associated heart-piece 55, 57, 59.

Figure 4:
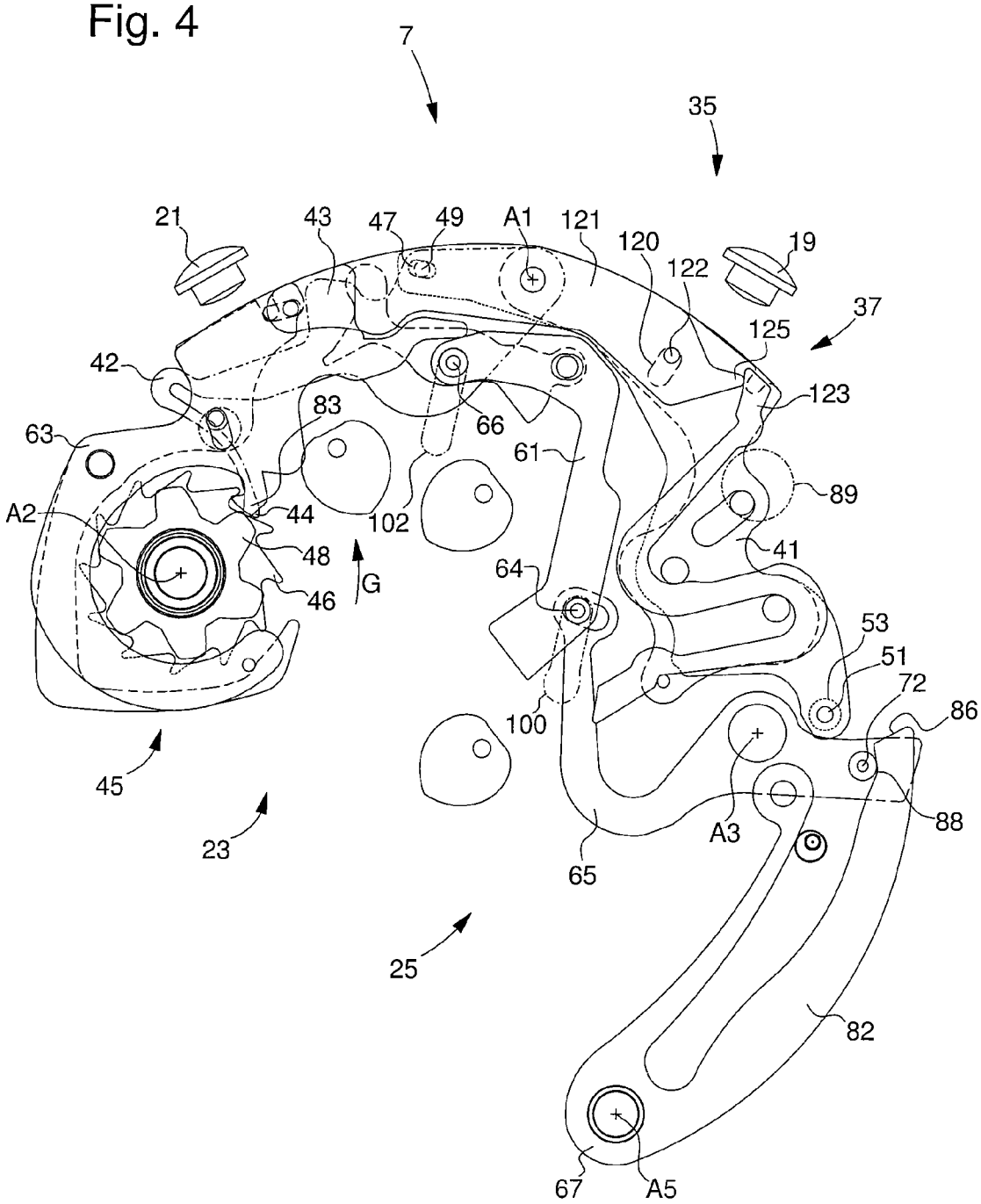
FIG. 4 is an overall view of the chronograph mechanism in its end position when being activated by the stop/start push-button.
Figure 5:
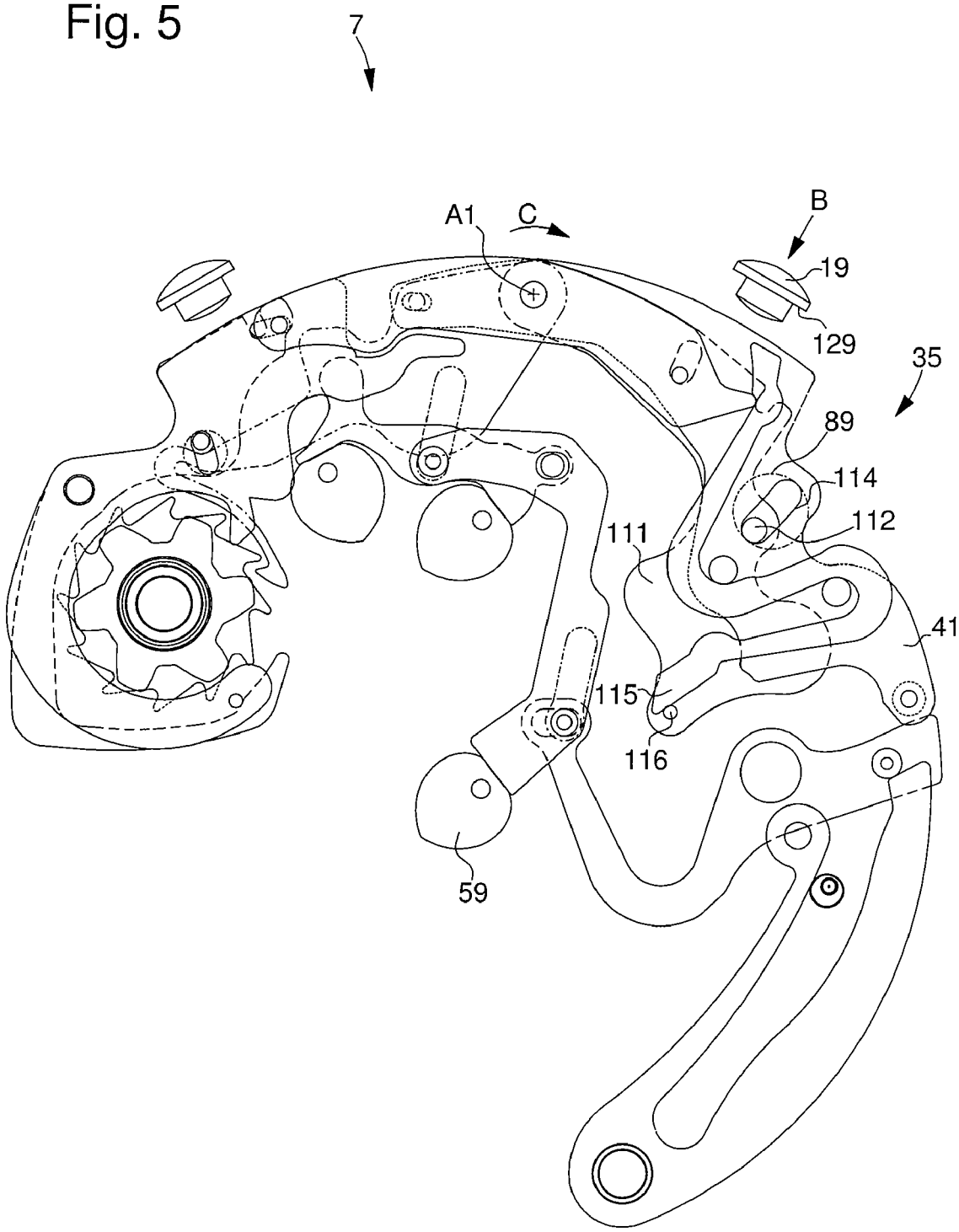
FIG. 5 is an overall view of the chronograph mechanism in its uncoupled position, when excessively activated by the stop/start push-button.
Figure 6:
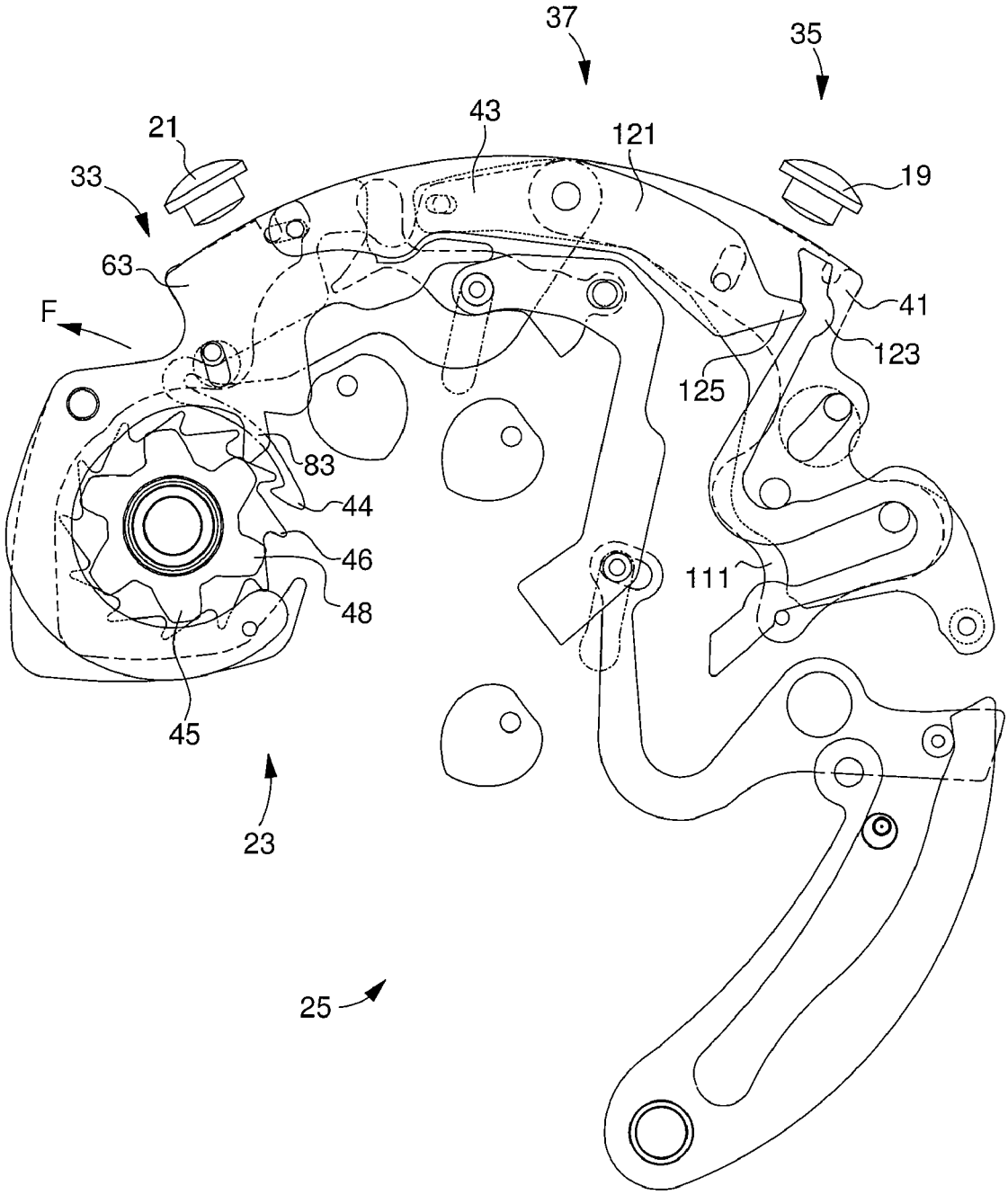
FIG. 6 is an overall view of a chronograph mechanism in its active position.
Figure 7:
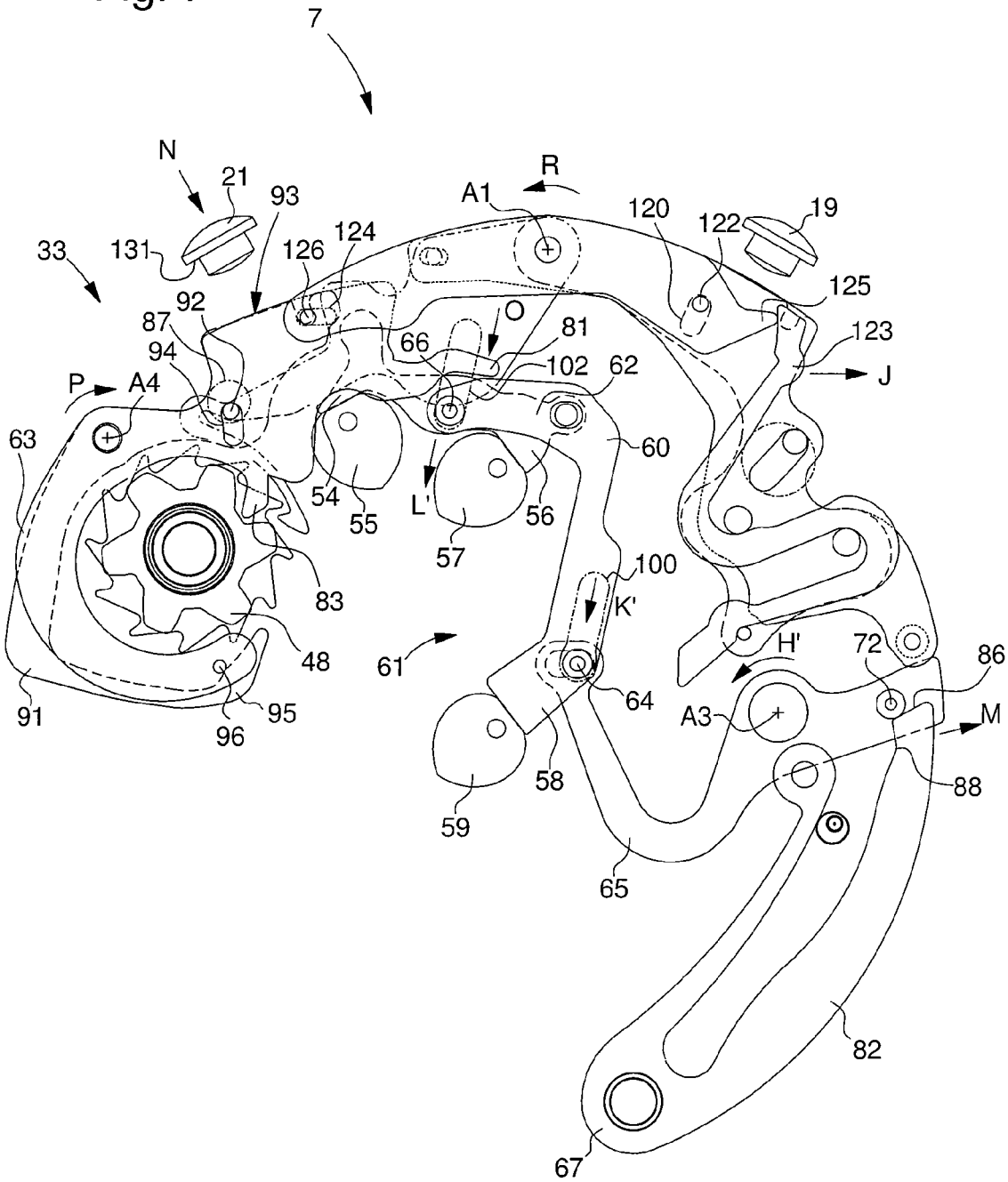
FIG. 7 is an overall view of the chronograph mechanism in its end position, when being activated by the reset push-button.
Figure 8:
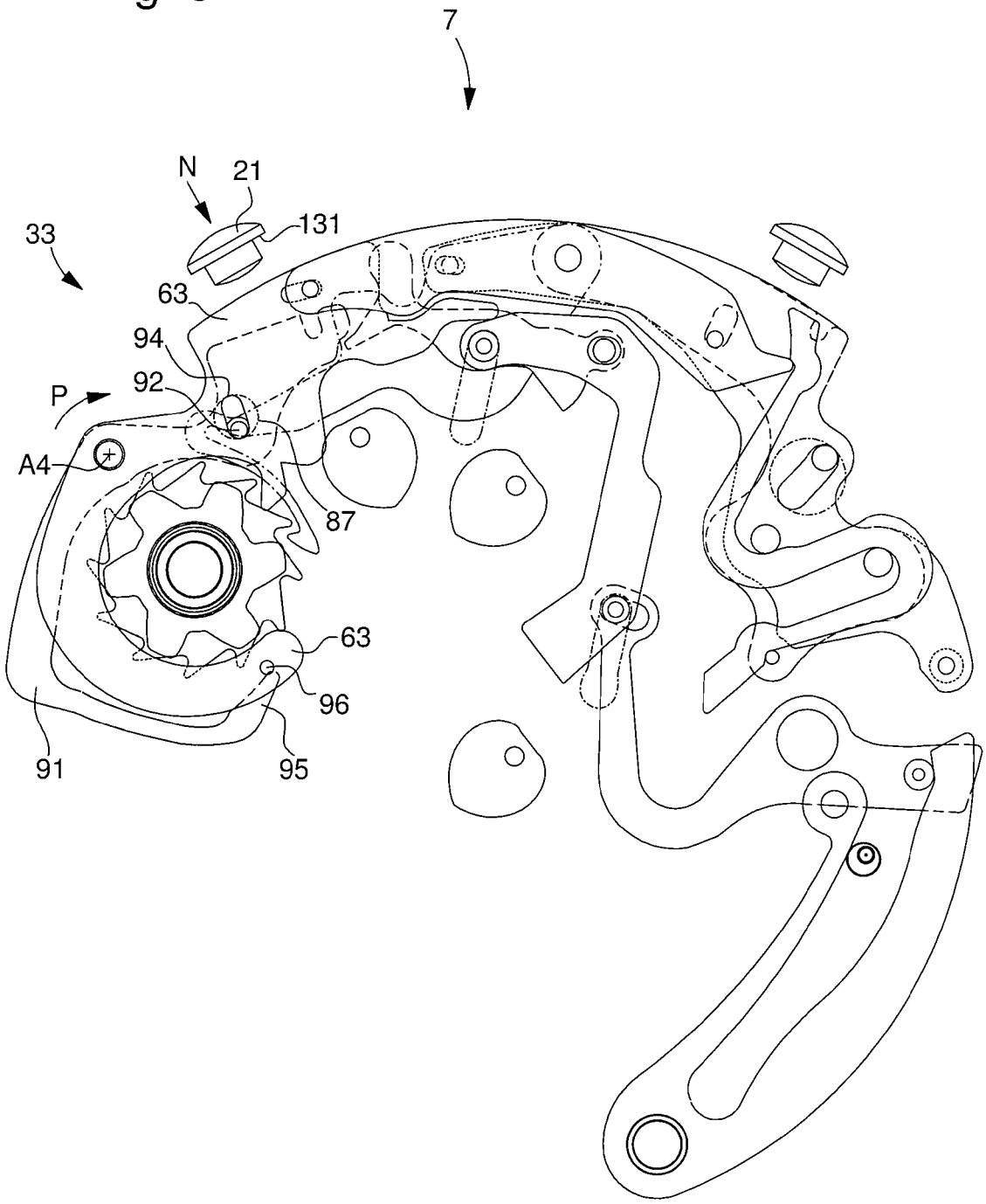
FIG. 8 is an overall view of the chronograph mechanism in its uncoupled position, when excessively activated by the reset push-button.

Hammer lever 65 can move hammer 61 between its active position (i.e. when stop members 54, 56 and 58 are against heart-pieces 55, 57 and 59 as in FIGS. 3, 5 and 7) and its inactive position (i.e. when stop members 54, 56 and 58 are moved away from heart-pieces 55, 57 and 59 as in FIGS. 4, 6 and 8). Hammer lever 65 is rotatably mounted against a pivot 105 forming an axis A3. The lever includes a pin 72, at one end, and an arm 73 at the other end. Pin 72 is fixedly mounted on the flank of lever 65 and is oriented approximately parallel to pin 51 of lever 41. Pin 72 comes into contact with hammer jumper spring 67. Pin 72 preferably also includes a coaxial roller for reducing friction.

Arm 73 is oriented approximately perpendicularly to the end comprising pin 72, due to the presence of a bent portion 74. The end of arm 73 includes hole 71, which preferably cooperates with the roller of the bottom part of stud 64. The orientation of arm 73, associated with the play allowed by hole 71, optimises the thrust of hammer 61, when lever 65 rotates about axis A3, by orienting said hammer approximately parallel to holes 100 and 102.

Reset lever 63 moves hammer 61 from its inactive position (i.e. when stop members 54, 56 and 58 are moved away from heart-pieces 55, 57 and 59 as in FIGS. 4, 6 and 8) towards its active position (i.e. when stop members 54, 56 and 58 are against heart-pieces 55, 57 and 59 as in FIGS. 3, 5 and 7). Reset lever 63 is rotatably mounted on pivot 107 that forms an axis A4. The reset lever is approximately w-shaped and includes, at one end thereof, an arm 81 that preferably comes into contact with a second roller of stud 66, in order to move hammer 61.

Reset lever 63 preferably includes, approximately at its median end, a finger 83 for limiting the rotation of said lever, in accordance with the operating mode of chronograph mechanism 7, i.e. depending upon whether the mechanism is in the stop or start position. Finger 83 thus cooperates with notched wheel 48, in order to limit the rotation of reset lever 63 mechanically, when finger 83 is opposite one of the columns of notched wheel 48 (as illustrated in FIGS. 4 and 6), and permit said rotation when it is located between two columns (as illustrated in FIGS. 3, 5, 7 and 8).

According to one advantageous feature of the invention, the hammer jumper spring 67 is bistable, i.e. it is capable of making hammer 61 stable both when it is in its active position and when it is in its inactive position. The jumper spring is generally U-shaped and one of the vertical parts 82 thereof is very rigid and preferably comes into contact with the roller of pin 72 of lever 65. Vertical part 82 is thus able to move away from, or closer to the other vertical part in an elastic manner, depending upon how pin 72 is stressed by rotating about pivot 109, which forms an axis A5. The second vertical part 85 is preferably thinner than the first, to provide the necessary elasticity.

Consequently, hammer jumper spring 67 is used for generating an antagonistic force during the movement M of vertical part 82 away from the other vertical part, i.e. the force necessary for pin 72 to move hammer lever 65 at the start of the movement. Advantageously, hammer jumper spring 67 is also used for generating a drive force during elastic let down, i.e. jumper spring 67 supplies sufficient force to return to its position of equilibrium, which can finish the movement of pin 72, as explained below.

In the example illustrated in FIGS. 3, 5 and 7, the stable position is shown when hammer 61 is active, i.e. when hammer lever 65 is held by its pin 72 in the position against the top face 86 of vertical part 82 of hammer jumper spring 67. Hammer jumper spring 67 thus exerts a force, via the top surface 86 thereof, which can counter the movement L and K of hammer 61 towards its inactive position.

In the example illustrated in FIGS. 4, 6 and 8, the stable position is shown, when hammer 61 is inactive, i.e. when the hammer lever 65 is held by its pin 72 in a position against a notch arranged on a lateral surface 88 of vertical portion 82 of hammer jumper spring 67. Hammer jumper spring 67 thus exerts a force, via the lateral surface 88 thereof (oriented approximately perpendicularly, relative to the force exerted by top face 86 in the active position), which can counter the movement of hammer 61 towards its active position. Of course, the gradients of each useful surface 86, 88 of jumper spring 67 can be adapted in accordance with the mechanism to which they are applied, by increasing and/or decreasing them and/or making them more or less rectilinear.

According to another advantageous feature of the invention, timepiece 1 includes anti-shock devices 33 and 35, which can uncouple the control members of the associated mechanism, when the force exerted is greater than a predetermined stress. In the following example, push-buttons 19 and 21 are used to explain the operation of the anti-shock devices according to the invention. However, the explanation is not limited to these embodiments. Thus, these devices could also be provided to secure another control member, such as, for example, crown 15 that controls time reset device 5 of timepiece 1.

Anti-shock device 33 protects chronograph mechanism 7 against any inadvertent activation of reset lever 63. The device is rotatably mounted along the same axis A4 as reset lever 63. Anti-shock device 33 includes a finger 92-groove 94 assembly and a main, approximately C-shaped part 91, the end of which includes a strike zone 93, and the other end of which includes a pin 96-jumper spring 95 assembly. Part 91 acts as an intermediate part between push-button 21 and reset lever 63 and is used to uncouple said elements.

Strike zone 93 includes a flange that is approximately perpendicular to the main plane of part 91 and opposite the back of push-button 21. The strike zone comes into contact with push-button 21 to transmit thereto its force to part 91. The finger 92-groove 94 assembly limits the relative movements between reset lever 63 and main part 91. In the example illustrated in FIG. 3, finger 92 is secured to part 91 and groove 94 of reset lever 63. However, the reverse assembly is evidently possible. Moreover, finger 92 is preferably mounted in a top hole 87, which is in approximately the same plane as holes 100 and 102, to limit the overall movement of the finger.

Finally, anti-shock device 33 advantageously includes a pin 96-jumper spring 95 assembly. According to the invention, this assembly mechanically detects when the forces transmitted in succession by push-button 21, strike zone 93 and part 91 are too intense, i.e. when the force transmitted is liable to damage chronograph mechanism 7. Other connections could, of course, be envisaged depending upon the anticipated application.

The mechanical connection between pin 96 and the notch of jumper spring 95 is adapted so that it is uncoupled, preferably, when a force of more than 25 N is transmitted thereto by push-button 21. Of course, in the opposite situation, i.e. if the force is less than said predetermined force, reset lever 63 is activated at the same time as main part 91.

The pin 96-jumper spring 95 assembly is preferably selected, since, in the normal position, it does not exert any force on chronograph mechanism 7, which means that it stresses the mechanism as little as possible. Moreover, the uncoupling force is very easy to configure, since it depends mainly on the geometry of the notch, relative to the rest of jumper spring 95, which means that the uncoupling force can easily be reproduced.

In the example illustrated in FIG. 3, pin 96 is mounted on the end of reset lever 63, opposite the end comprising arm 81, and jumper spring 95 is arranged on the end of part 91, opposite the end comprising strike zone 93. However, it is evidently possible to mount the pin 96-jumper spring 95 assembly in the reverse manner.

The other anti-shock device 35 protects chronograph mechanism 7 against any inadvertent activation of lever 41. The device is rotatably mounted along the same axis A1 as lever 41. Anti-shock device 35 includes a finger 112-groove 114 assembly and a main part 111, approximately in the shape of an arc of a circle, the end of which includes a strike zone 113 and the other end of which includes a pin 116-jumper spring 115 assembly. Part 111 acts as an intermediate part, between push-button 19 and reset lever 41 and is used to uncouple said elements.

Strike zone 113 includes a flange that is approximately perpendicular to the main plane of part 111 and opposite the back of push-button 19. The strike zone comes into contact with push-button 19 to transmit thereto its force to part 111. The finger 112-groove 114 assembly limits the relative movements between lever 41 and main part 111. In the example illustrated in FIG. 3, finger 112 is secured to part 111 and groove 114 of lever 41. However, the reverse assembly is evidently possible. Moreover, as for finger 92, finger 112 is also mounted in a top hole 89, which is in approximately the same plane as holes 100 and 102, to limit the overall movement of the finger.

Advantageously, anti-shock device 35 includes a pin 116-jumper spring 115 assembly. According to the configuration of the invention, this assembly is for mechanically detecting when the forces transmitted in succession by push-button 19, strike zone 113 and part 111 are too intense, i.e. when the force transmitted is liable to damage chronograph mechanism 7.

In the example illustrated in FIG. 3, pin 116 is mounted on the opposite end to that of axis A1, of main part 111, in an approximately perpendicular manner. Jumper spring 115 is added onto lever 41. The assembly is preferably achieved using a flange (not shown to avoid overloading the drawing), which is connected to lever 41 via pins 117 and 118 so as to trap jumper spring 115 between said flange and said lever. The mechanical connection, between pin 116 and the notch of jumper spring 115, is adapted to be uncoupled, preferably, when a force of more than 25 N is transmitted thereto by push-button 19.

Of course, in the opposite situation, i.e. if the force is less than said predetermined force, lever 41 is activated at the same time as main part 111. Finally, as for anti-shock device 33, the pin 116-jumper spring 115 assembly could evidently be mounted in the reverse manner.

Main parts 91 and 111 preferably have approximately the same thickness as reset lever 63 and lever 41. The thickness of each of the main parts can thus be less than 0.5 mm.

According to an additional advantageous feature, timepiece 1 includes a device 37 for equalising force between two of its control members. In the example illustrated in FIGS. 2 to 8, force equalising device 37 is for personalising the push sensitivity of push-buttons 19 and 21, which control chronograph mechanism 7, when they are pushed in. However, one could envisage device 37 equalising force between two other control members of timepiece 1. Advantageously, said personalisation consists in generating an antagonistic force, when each push-button 19, 21 is pushed in, using one device for both push-buttons.

In the example illustrated in FIG. 3, force equalising device 37 includes an intermediate lever 121, a jumper spring 123, a first finger 122-groove 120 assembly and a second finger 126-groove 124 assembly. Intermediate lever 121 is rotatably mounted approximately in the centre, against axis A1. Intermediate lever 121 selectively transmits said antagonistic force to the dedicated kinematic chain of push-button 19, 21, which is activated as explained below. The antagonistic force is induced by the relative movement between the approximately pointed end 125 of lever 121 and the notch of jumper spring 123, which is added to lever 41.

In order for stress equalising device 37 to operate when the two push-buttons 19, 21 are pushed in, lever 121 uses the two finger-groove assemblies to connect respectively, lever 41, i.e. one part of the kinematic train associated with push-button 19, and reset lever 63, i.e. one part of the kinematic chain associated with push-button 21.

Thus, finger 122 is mounted on the same end of lever 121 as tip 125 in an approximately perpendicular manner and it slides into groove 120 arranged in lever 41. Moreover, finger 126 is mounted on the other end, opposite to the tip 125 end, in an approximately perpendicular manner and it slides into groove 124 arranged in reset lever 63.

Advantageously, according to the invention, jumper spring 115 of anti-shock device 35 and jumper spring 123 of force equalising device 37 share the same securing means 117, 118, mounted on lever 41. They therefore form a monoblock part 127 which forms a double jumper spring.

As FIG. 3 shows, represented by various lines, there are at least four parts that are at least partially stacked on each other, in the area of axis A1. Preferably, one end of the consecutive stack is intermediate lever 121, then lever 41, main part 111 and lever hook 43.

The operation of timepiece 1 and, more specifically, of chronograph mechanism 7, will now be explained with reference to FIGS. 3 to 8. These Figures only show one part of chronograph mechanism 7, to facilitate comprehension of the invention. Moreover, push-buttons 19 and 21 are always deliberately placed in the same, non-pushed in position, in order to show better the amount of movement made by said push-buttons 19, 21 between the Figures.

FIG. 3 shows chronograph mechanism 7 when it is inactive, i.e. when indicator device 17 is not being used. It will be noted that reset device 25 is active, i.e. indicator device 17 is initialised, and that this position is made stable, preferably via contact between the roller of pin 72 and the top surface 86 of jumper spring 67.

Further, anti-shock devices 33 and 35 are in their normal position, i.e. respectively coupled to their reset lever 63 and lever 41. Moreover, force equalising device 37 is in its position of equilibrium, i.e. tip 125 of intermediate lever 121 is housed in the notch in jumper spring 123. Finally, column wheel 45 of control system 23 is in the position in which it allows reset device 25 to be activated.

When chronograph mechanism 7 is operating normally, the user activates the start/stop push-button 19 along arrow B, visible in FIG. 3. In a first phase, push-button 19 moves approximately along a translation B until the back of push-button 19 comes into contact with strike zone 113 of anti-shock device 35. In a second phase, the movement of push-button 19 is transmitted to main part 111 of anti-shock device 35, which then imparts a rotation C about axis A1.

If the speed of movement B exerted on push-button 19 induces force on the jumper spring 115-pin 116 link, preferably greater than 25 N, anti-shock device 35 passes into the uncoupled position. This means that the link between pin 116 of main part 111 and the notch of jumper spring 115 mounted on lever 41 comes undone. Consequently, translation B of push-button 19, approximately oriented towards heart-piece 59, only induces rotation C of main part 111 of anti-shock device 35 in the backward direction. the rotation C of main part 111 is limited when finger 112 meets the end of hole 89, as illustrated in FIG. 5.

Preferably, at this stage or just before, a collar 129 of push-button 19 (visible in FIG. 5), abuts against case 11 of timepiece 1, which limits the travel of push-button 19 more securely. By way of alternative or complementary element, one end of the travel stop member could also be provided in strike zone 113. At any time, when push-button 19 is released, the let down force of jumper spring 115 returns pin 116 to the notch in jumper spring 115. Anti-shock device 35 thus protects the kinematic chain attached to lever 41 and is automatically and mechanically repositioned.

If the speed of movement B exerted on push-button 19 induces a force on the jumper spring 115-pin 116 link, which is, preferably, less than 25 N, anti-shock device 35 remains in the normal position and, in a third phase, transmits its movement to lever 41. Lever 41 is driven in the same backward rotation C about axis A1. During the travel of lever 41, the amplitude of rotation C, made in the third phase, allows hammer lever 65 to be moved via the movement D of its pin 51 and, lever hook 43 to be moved, via the movement E of its hole 47.

Consequently, in a fourth phase, stud 49 of lever hook 43, trapped in hole 47, also drives lever hook 43 in backward rotation C about axis A1. Hook 44 thus moves closer to the tooth of ratchet wheel 46, which is opposite thereto, via an approximately tangential movement F. In a fifth phase, hook 44 comes into contact with ratchet wheel 46 and forces column wheel 45 to impart a trigonometric movement G about axis A2.

At the end of the fifth phase, which corresponds to the maximum travel of hook 44, as illustrated in FIG. 4, column wheel 45 has pivoted by an angle approximately equal to 30 degrees, such that one column of notched wheel 48 is facing finger 83 of reset lever 63. This enables control system 23 to change state while preventing reset device 25 to be activated.

In a way that is not illustrated, to avoid overloading the drawings, said state change controls the activation of coupling device 29, i.e. chronograph mechanism 7 is made integral with timepiece movement 3 and the deactivation of immobilising device 31, i.e. gear train device 27 is not immobilised. Indeed, column wheel 45 preferably includes a third toothed wheel, below ratchet wheel 46, which enables said devices to be controlled.

During said fourth and fifth phases, the thrust movement D of pin 51 moves hammer lever 65. The movement of hammer lever 65 is a backward rotational movement H about axis A3. In a first time period, which is preferably after the start of the fourth phase, pin 51 comes into contact, preferably via its roller 53, with the end of hammer lever 65, which faces pin 51. Lever 65 is in a stable position because of the contact between its pin 72 and the top surface 86 of jumper spring 67.

Thus, advantageously, during the start of rotation C of lever 41 (i.e. before the fifth phase and the first time period), the return force on push-button 19 that the user feels is generated mainly by the relative movement of jumper spring 123, which is driven in movement J about axis A1 by lever 41, relative to the tip 125 of intermediate lever 121.

At the start of the first time period, the thrust force on push-button 19 has therefore to counter the combined antagonistic forces exerted mainly by the movement J of jumper spring 123 away from tip 125 and the movement M of vertical part 82 of jumper spring 67 away from pin 72.

Preferably, the second time period starts when lever 41 has completed two thirds of its travel. The second time period corresponds to the moment, preferably, when the roller of pin 72 of lever 65 passes the common edge between top surface 86 and lateral surface 88 of vertical part 82 of jumper spring 67. At that moment, the movement B of push-button 19 no longer forces jumper spring 67 to move away in movement M, but, conversely, allows jumper spring 67 to tend to return to the position of equilibrium.

Consequently, approximately at the start of the second time period, hammer lever 65 is no longer moved by the force exerted on push-button 19, but approximately by the force exerted by the trigonometric let down rotation of vertical part 82 of jumper spring 67 about axis A5. The end of the movement (H, K, L) of reset device 25 is then carried out "automatically".

As visible in FIG. 4, at the end of the second time period (approximately corresponding to the end of the fifth phase), roller 53 of pin 51 is no longer in contact with hammer lever 65 and the roller of pin 72 thereof is housed in the notch of lateral part 88 of jumper spring 67. the movement of lever 65 has directly driven stud 64 of hammer 61 along translation K in hole 100, and, indirectly, second stud 66 of hammer 61 along translation L in hole 102, such that hammer 61 has moved away from heart-pieces 55, 57 and 59. Consequently, the reset device 25, illustrated in FIG. 4, is in its stable, deactivated position.

It is thus clear that, at the respective ends, which are approximately simultaneous, of the fifth phase and the second time period, chronograph mechanism 7 is activated, i.e. indicator device 17 starts to display the elapsed time. However, at any time, if the force exerted on push-button 19 induces force on the jumper spring 115-pin 116 link that exceeds 25 N, lever 41 is no longer driven by anti-shock device 35.

FIG. 4 also shows that the force equalising device 37 is in the most distant position relative to the position of equilibrium shown in FIG. 3. It can be seen that the relative movement of tip 125 of intermediate lever 121 relative to jumper spring 123 has been achieved entirely by the mutual movement of said jumper spring 123 with lever 41. This is made possible by the movement of groove 120 arranged on lever 41 against finger 122 of intermediate lever 121.

Consequently, simply releasing push-button 19 will mechanically release the force between tip 125 of intermediate lever 121 and jumper spring 123. Force equalising device 37 then tends to return to its position of equilibrium and drives lever 41 in its movement, and, incidentally, by the kinematic chain explained above, lever hook 43 and main part 111, without reset device 25 changing the way it operates.

As FIG. 6 shows, chronograph mechanism 7 is thus activated, i.e. indicator device 17 continues to measure the elapsed time, reset device 25 is in the inactive stable position, force equalising device 37 is in the position of equilibrium and the kinematic chains connected to push-buttons 19 and 21 are in the rest position. At this stage, because of column wheel 45 of control system 23, it is not possible to activate the reset device 25. Moreover, as explained above, coupling device 29 is activated and immobilising device 31 is deactivated.

When the user wishes to stop measuring time, i.e. to stop indicator device 17, he presses on push-button 19 again. As explained previously if the force exerted on push-button 19 generates force greater than 25 N on the jumper spring 115-pin 116 link, anti-shock device 35 passes into the uncoupled position and does not drive lever 41. If the pressure on push-button 19 is less than the predetermined force, the kinematic chain, explained above, drives lever hook 43 in tangential movement F, which imparts a trigonometric rotation G, over an angle of approximately 30 degrees, on column wheel 45.

Consequently, control system 23 returns to an approximately symmetrical state to that of FIG. 3, which means that it again allows reset device 25 to be activated (finger 83 of reset lever 63 again faces a space between two columns of notched wheel 48). This state also deactivates coupling device 29 (i.e. it separates chronograph mechanism 7 from timepiece movement 3) and activates immobilising device 31 (i.e. it makes gear train device 27 static), for example by means of said third wheel of column wheel 45, as explained above. The user can then comfortably read the elapsed time that he wished to measure, via indicator device 17 (made immobile) of display system 9.

If the user wishes to restart chronograph mechanism 7, he presses on push-button 19 to make control system 23 change state again, which feels exactly the same as when he first activated chronograph mechanism 7. This is made possible by force equalising device 37.

If the user wishes to reinitialise indicator device 17, for example to make a new time measurement, he then presses on push-button 21, as seen in FIG. 7. In a first step, push-button 21 moves approximately along a translation N until the back of push-button 21 comes into contact with strike zone 93 of anti-shock device 33. In a second step, the movement of push-button 21 is transmitted to main part 91 of anti-shock device 33, which then imparts a backward rotation P about axis A4.

If the speed of movement N exerted on push-button 21 induces a force preferably greater than 25 N on the jumper spring 95-pin 96 link, anti-shock device 33 passes into the uncoupled position. This means that the link between pin 96 of reset lever 63 and the notch of jumper spring 95, arranged on main part 91, comes undone. Consequently, translation N of push-button 21, which is approximately oriented towards heart-piece 59 only induces rotation P of main part 91 of anti-shock device 33 backwards. Rotation P of main part 91 is limited when finger 92 encounters the end of hole 87 as illustrated in FIG. 8.

Preferably, at this stage or before, a collar 131 of push-button 21 (visible in FIG. 8) abuts against case 11 of timepiece 1, which limits the travel of push-button 21 in a more secure manner. By way of alternative or complementary element, an end of travel stop member could also be provided for strike zone 93. At any time, when push-button 21 is released, the let down force of jumper spring 95 returns it towards pin 96. Anti-shock device 33 thus protects the kinematic chain attached to reset lever 63 and is automatically repositioned in a mechanical manner.

If the speed of movement N exerted on push-button 21 induces a force preferably less than 25 N on the jumper spring 95-pin 96 link, anti-shock device 33 remains in the normal position and, in a third step, transmits its movement to reset lever 63. Reset lever 63 and, incidentally its finger 83 and arm 81, are driven in the same backward rotation P about axis A4.

In a fourth step, arm 81, via its movement O approximately oriented towards heart-pieces 55, 57 and 59, comes into contact with the second roller of stud 66 and starts to drive the roller. Via the kinematic chain of reset device 25, the movement O of arm 81 of reset lever 63 is translated into movement L' (approximately the reverse of L explained above) of stud 66, K' of stud 64 (approximately the reverse of K explained above) and H' of hammer lever 65 (approximately the reverse of H explained above). However, as hammer lever 65 is in a stable position, because of the contact of the roller of its pin 72 against the lateral surface 88 of jumper spring 67, it exerts an antagonistic movement to movement O.

Advantageously, during the start of rotation P of reset lever 63 (i.e. before the fourth step), the return force on push-button 21 felt by the user is mainly generated by the movement of tip 125 of intermediate lever 121, which is driven in movement R about axis A1 by reset lever 63 by means of the finger 126-groove 124 assembly, relative to jumper spring 123.

At the start of the fourth step, the thrust force on push-button 21 thus has to counter the combined antagonistic forces exerted mainly by the movement J of jumper spring 123 away from tip 125 and the movement M of vertical part 82 of jumper spring 67 away from pin 72.

The fifth step is preferably initiated when reset lever 63 has completed two thirds of its travel. The fifth step corresponds to the moment when the roller of pin 72 of lever 65 passes the common edge between the top surface 86 and the lateral surface 88 of vertical part 82 of jumper spring 67. In fact, at that moment, movement N of push-button 21 no longer forces jumper spring 67 to move away in movement M, but, conversely, allows jumper spring 67 to tend to return to a position of equilibrium.

Consequently, approximately at the start of the fifth step, hammer lever 65 is no longer moved by the force exerted on push-button 21, but approximately by the force exerted by the trigonometric let down rotation of vertical part 82 of jumper spring 67 about axis A5. The end of the travel of the movement (H', K', L') of reset device 25 is then carried out "automatically".

As FIG. 7 shows, at the end of the fifth step, arm 81 of reset lever 63 is no longer in contact with the second roller of stud 66 of hammer 61 and the roller of pin 72 of hammer lever 65 is housed against the top part 86 of jumper spring 67. The movement of lever 65 has directly driven stud 64 of hammer 61 along translation K' in hole 100 and, indirectly, the second stud 66 of hammer 61 along translation L' in hole 102, such that hammer 61 has come into contact with heart-pieces 55, 57 and 59. The reset device 25 is thus again activated.

The double arm 61, 62 configuration of hammer 61 explained above improves the balance of the strike forces of heart-pieces 55, 57 and 59 by stop members 54, 56, 58 of hammer 61. Moreover, advantageously, the strike forces are no longer dependent upon the force exerted on push-button 21, but on the let down force of jumper spring 67.

It is thus clear that, at the end of the fifth step, chronograph mechanism 7 is deactivated and its indicator device 17 has been reinitialised. However, at any time, if the force exerted on push-button 21 induces a force that exceeds 25 N on the jumper spring 95-pin 96 link, reset lever 63 is no longer driven by anti-shock device 33.

Anti-shock devices 33 and 35 thus protect chronograph mechanism 7 against any violent activation of push-buttons 19 and 21. Devices 33 and 35 also protect chronograph mechanism 7 if both push-buttons 19 and 21 are activated at the same time. In fact, one push-button 19 tends to make reset system 25 inactive and the other 21, tends to make said reset system active. Owing to devices 33 and 35, as soon as at least one of links 116-115 and 95-96 reaches its predetermined stress threshold, preferably equal to 25 N, it is uncoupled and leaves the other link in control of reset device 25. Likewise, notched wheel 48 of column wheel 45 is not liable to be damaged by finger 83 pressing violently on reset lever 63.

FIG. 7 also shows that force equalising device 37 is in the most distant position from the position of equilibrium shown in FIG. 3. It can be seen, in particular, that the movement of tip 125 of intermediate lever 121 relative to jumper spring 123 has been entirely achieved by the movement of intermediate lever 121. This is made possible by the movement of finger 122 in groove 120 arranged on lever 41.

Advantageously, simply releasing push-button 21 will mechanically release the stress between tip 125 of intermediate lever 121 and jumper spring 123. Force equalising device 37 then tends to return to its position of equilibrium and, in its movement, drives rest lever 63, via the finger 126-groove 124 assembly and, incidentally, main part 91 by the pin 96-jumper spring 95 assembly.

Chronograph mechanism 7 is thus again in the configuration of FIG. 3. Chronograph mechanism 7 is thus inactive, reset device 25 is in the stable active position, force equalising device 37 is in its position of equilibrium and the kinematic trains connected to push-buttons 19 and 21 are in their rest position.

Preferably, in order for the touch sensitivity of push-buttons 19 and 21 to be approximately equal over time, the force for uncoupling the assemblies of jumper springs 115/95 and pins 116/96 of anti-shock devices 35/33 is greater than that of the tip 125-jumper spring 123 assembly, which is greater than that of the pin 72-surfaces 86/88 assemblies of jumper spring 67.

Of course, the present invention is not limited to the example illustrated but is capable of various variants and alterations, which will be clear to those skilled in the art. In particular, the hole 47-stud 49 assembly and/or finger 68/122/126-groove 69/120/124 assemblies can be reversed without affecting the operation of timepiece 1. This is of course true for other ways of mounting assemblies of the timepiece.

Moreover, movements B, N for activating push-buttons 19 and 21 are not limited to translations, any movement and/or control member other than a push-button can be envisaged.

In order to simplify timepiece 1, one could envisage that one or both push-buttons 19, 21 directly control, i.e. push, their associated functions, i.e. without any intermediate anti-shock device 33, 35.

The user of rollers is not limited to the example in the Figures as explained above, but any timepiece can include more or less rollers and/or different roller configurations (diameter of the arbour on which the rollers are mounted, thickness of the roller, etc.).

In order to make each state of column wheel 45 stable, a jumper spring that cooperates with one of the toothings of the column wheel could be provided. Moreover, the second time period could be initiated before or after two thirds of the travel of lever 41.

In a similar manner, the second time period could be initiated before a often two third of the travel of reset lever 63.

Finally, a cam could be arranged on the end of hammer lever 65, which comes into contact with the roller of pin 51 in order to change the development and intensity of the force necessary for said hammer lever to pivot via lever 41.

What is claimed is:

1. A chronograph mechanism including:

(a) an elapsed time indicator member having heart-pieces connected thereto;

(b) a reset control member; and (c) a reset device for said indicator member including a hammer having stop members, wherein the reset device is mounted in translation between an inactive position, wherein the hammer is disposed away from the heart-pieces, and an active position, wherein the hammer is disposed so that the stop members of said hammer exert a reset force against the heart-pieces, wherein the hammer includes first and second studs, wherein the first and second studs, respectively, are slidably mounted in first and second holes arranged in a part located above the chronograph mechanism, so that movement vectors of the first and second studs between the inactive and active positions are collinear, but not coincident, thereby moving the hammer.

2. The chronograph mechanism according to claim 1, wherein the first stud is secured to a hammer lever for moving the hammer from the active position to the inactive position.

3. The chronograph mechanism according to claim 2, wherein the first stud is further mounted so as to slide in a third hole, arranged at one end of the hammer lever.

4. The chronograph mechanism according to claim 3, wherein the first end has an arm, which is approximately oriented in the extension of the hammer, so as to optimise the movement of said hammer by the lever.

5. The chronograph mechanism according to claim 2, wherein the hammer lever is rotatably mounted.

6. The chronograph mechanism according to claim 2, wherein the hammer lever cooperates with a bistable type jumper spring that makes each of the two positions of the hammer stable.

7. The chronograph mechanism according to claim 6, wherein the movement of the hammer lever, from the active position of the hammer to the inactive position, is initiated by contact between the hammer and a part that is mechanically driven by a control member for stopping and starting said mechanism.

8. The chronograph mechanism according to claim 6, wherein the movement of the hammer lever, from the inactive position of the hammer to the active position, is initiated by contact between the second stud and a part that is mechanically driven by a member controlling the resetting of said mechanism.

9. The chronograph mechanism according to claim 6, wherein each movement of the hammer lever ends with the elastic let down of the jumper spring.

10. The chronograph mechanism according to claim 1, wherein the hammer includes two arms that are hinged to each other.

11. A timepiece including the chronograph mechanism according to claim 1.

12. A chronograph mechanism including:

(a) an elapsed time indicator member having heart-pieces connected thereto;

(b) a reset control member; and (c) a reset device for said indicator member including a hammer having stop members, wherein the reset device is mounted in translation between an inactive position, wherein the hammer is disposed away from the heart-pieces, and an active position, wherein the hammer is disposed so that the stop members exert a reset force against the heart-pieces, wherein the hammer includes first and second studs, wherein the first and second studs, respectively, are slidably mounted in first and second holes arranged in a part located above the chronograph mechanism, so that movement vectors of the first and second studs between the inactive and active positions are collinear, but not coincident, thereby moving the hammer, wherein the first stud is secured to a hammer lever for moving the hammer from the active position to the inactive position, wherein the hammer lever cooperates with a bistable type jumper spring that makes each of the two positions of the hammer stable, and wherein the hammer lever includes a pin that comes into contact with a different surface of two surfaces of the jumper spring for each position of the hammer, in order to makes the each of the two positions of the hammer stable via the jumper spring.

13. The chronograph mechanism according to claim 12, wherein at least one of the two surfaces of the jumper spring includes a notch for receiving the pin of the lever, in order to improve the stability of cooperation between the lever and the jumper spring.

14. The chronograph mechanism according to claim 12, wherein the two surfaces of the jumper spring are mounted approximately perpendicularly in relation to each other.

* * * * *